US006666046B1

(12) United States Patent
Lockett et al.

(10) Patent No.: US 6,666,046 B1
(45) Date of Patent: Dec. 23, 2003

(54) DUAL SECTION REFRIGERATION SYSTEM

(75) Inventors: Michael James Lockett, Grand Island, NY (US); Richard J. Jibb, Amherst, NY (US); Vijayaraghavan Srinivasan Chakravarthy, Williamsville, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/259,357

(22) Filed: Sep. 30, 2002

(51) Int. Cl.[7] ..... F25B 41/00; F25B 1/00
(52) U.S. Cl. ..... 62/502; 62/513
(58) Field of Search ..... 62/507, 513, 612, 62/617, 907, 36, 50.2

(56) References Cited

U.S. PATENT DOCUMENTS

| | | | | | |
|---|---|---|---|---|---|
| 4,251,247 | A | * | 2/1981 | Gauberthier et al. | 62/612 |
| 4,455,158 | A | | 6/1984 | Vines et al. | 62/28 |
| 4,496,382 | A | | 1/1985 | Geist et al. | 62/31 |
| 5,438,836 | A | | 8/1995 | Srinivasan et al. | 62/36 |
| 5,813,250 | A | | 9/1998 | Ueno et al. | 62/612 |
| 6,041,621 | A | | 3/2000 | Olszewski et al. | 62/613 |
| 6,044,902 | A | | 4/2000 | Pahade et al. | 165/166 |
| 6,053,008 | A | | 4/2000 | Arman et al. | 62/646 |
| 6,065,305 | A | | 5/2000 | Arman et al. | 62/613 |
| 6,119,479 | A | * | 9/2000 | Roberts et al. | 62/612 |
| 6,220,053 | B1 | | 4/2001 | Hass, Jr. et al. | 62/613 |
| 6,269,655 | B1 | * | 8/2001 | Roberts et al. | 62/612 |
| 6,308,531 | B1 | * | 10/2001 | Roberts et al. | 62/611 |
| 6,327,865 | B1 | * | 12/2001 | Bonaquist et al. | 62/79 |
| 6,347,531 | B1 | * | 2/2002 | Roberts et al. | 62/612 |
| 6,393,866 | B1 | | 5/2002 | Srinivasan et al. | 62/643 |

* cited by examiner

*Primary Examiner*—Melvin Jones
(74) *Attorney, Agent, or Firm*—Stanley Ktorides

(57) ABSTRACT

A refrigeration system particularly useful with a multicomponent refrigerant fluid wherein the refrigerant fluid is cooled in an upward leg of a first vertically oriented heat exchanger section and further cooled in a downward leg of a second vertically oriented heat exchanger section prior to refrigeration generation and serial recycle flow through the two heat exchanger sections.

12 Claims, 2 Drawing Sheets

DUAL SECTION REFRIGERATION SYSTEM

TECHNICAL FIELD

This invention relates generally to the generation and the provision of refrigeration and is particularly advantageous for use with a multicomponent refrigerant fluid.

BACKGROUND ART

Refrigeration is used extensively in the freezing of foods, cryogenic rectification of air, production of pharmaceuticals, liquefaction of natural gas, and in many other applications wherein refrigeration is required to provide cooling duty to a refrigeration load.

A recent significant advancement in the field of refrigeration is the development of refrigeration systems using multicomponent refrigerants which are able to generate refrigeration much more efficiently than conventional systems. These refrigeration systems, also known as mixed gas refrigerant systems or MGR systems, are particularly attractive for providing refrigeration at very low or cryogenic temperatures such as below −80° F.

A number of problems arise when small scale MGR systems are increased to industrial scale. An advantage inherent in a mixed refrigerant cycle is that the saturation temperature increases as more of the liquid phase is vaporized, producing a temperature glide. This allows refrigeration over a wide temperature range. If the cross sectional area provided for flow is too high the difference between the vapor and liquid velocity will be great. If liquid velocity is very low, or liquid ceases to flow, then the local equilibrium between vapor and liquid will be lost in favor of equilibrium between a large region of liquid and the vapor generated from its surface. This is termed "pool boiling" or "pot boiling", and is the cause of a degradation in performance.

To avoid pool boiling the vapor velocity must be high, so the optimum design of the heat exchanger is such that its height greatly exceeds its width. The problem with a long thin heat exchanger is that the cold box package containing the system must be very tall. Tall heat exchangers are a particular problem when the system must be installed indoors. A good example of an indoor system is a mixed gas refrigerant system used for food freezing.

Another problem occurs in positioning the aftercooler relative to a tall main heat exchanger. If the aftercooler is situated on top of the main heat exchanger then the overall system height is increased, and expensive mechanical support is required. If the aftercooler is located on the ground it is necessary to transfer a two-phase liquid and vapor mixture to the top of the main heat exchanger. This second option greatly increases the system pressure loss, and in turn the electrical power consumption of the compressor required to drive the refrigerant flow. A third option is to separate the liquid and vapor phases at ground level, with the liquid being separately pumped to the top of the main heat exchanger. However, this introduces equipment with moving parts and is generally undesirable.

Yet another problem concerns drainage of refrigerant when a refrigeration system involving internal recycle of liquid is shut down. Such cycles typically are used to provide refrigeration below 120K. It is critical that heavier components of the mixture (i.e. those with low volatility) have a low concentration in the coldest region of the heat exchanger. This is because they can freeze and block the passages of the heat exchanger. In a conventional system the warm end of the process is at the top of the heat exchanger so the heavy components, in liquid form, drain naturally towards the lowest (coldest) point. To prevent this check valves are sometimes used, but check valves are problematic due to leakage and other difficulties.

Accordingly, it is an object of this invention to provide an improved refrigeration system which may be effectively employed with a multicomponent refrigerant fluid.

It is another object of this invention to provide an improved refrigeration system which can be effectively operated on an industrial scale while overcoming problems experienced with conventional systems especially when a multicomponent refrigerant fluid is employed.

SUMMARY OF THE INVENTION

The above and other objects, which will become apparent to those skilled in the art upon a reading of this disclosure, are attained by the present invention, one aspect of which is:

A method for providing refrigeration to a refrigeration load comprising:

(A) compressing a warm refrigerant fluid, and cooling the compressed refrigerant fluid by upward flow through a first heat exchanger section;

(B) further cooling the cooled refrigerant fluid by downward flow through a second heat exchanger section, expanding the further cooled refrigerant fluid to generate refrigeration, and providing refrigeration from the refrigeration bearing refrigerant fluid to a refrigeration load;

(C) warming the resulting refrigerant fluid by indirect heat exchange with the further cooling refrigerant fluid; and (D) further warming the resulting refrigerant fluid by indirect heat exchange with the cooling compressed refrigerant fluid to produce said warm refrigerant fluid.

Another aspect of the invention is:

A dual section refrigeration system comprising:

(A) a first vertically oriented heat exchanger section, a compressor, and means for passing refrigerant fluid from the compressor to the bottom of the first vertically oriented heat exchanger section;

(B) a second vertically oriented heat exchanger section, and means for passing refrigerant fluid from the top of the first vertically oriented heat exchanger section to the top of the second vertically oriented heat exchanger section;

(C) an expansion device, means for passing refrigerant fluid from the bottom of the second vertically oriented heat exchanger section to the expansion device, and means for passing refrigerant fluid from the expansion device to the bottom of the second vertically oriented heat exchanger section; and (D) means for passing refrigerant fluid from the top of the second vertically oriented heat exchanger section to the top of the first vertically oriented heat exchanger section, and means for passing refrigerant fluid from the bottom of the first vertically oriented heat exchanger section to the compressor.

As used herein the term "refrigeration load" means a fluid or object that requires a reduction in energy, or removal of heat, to lower its temperature or to keep its temperature from rising.

used herein the term "expansion" means to effect a reduction in pressure.

As used herein the term "expansion device" means apparatus for effecting expansion of a fluid while work expanding the fluid to generate refrigeration.

As used herein the term "compressor" means apparatus for effecting compression of a fluid.

As used herein the term "multicomponent refrigerant" means a fluid comprising two or more species and capable of generating refrigeration.

As used herein the term "refrigeration" means the capability to absorb heat from a subambient temperature system and to reject it at a superambient temperature.

As used herein the term "refrigerant" means fluid in a refrigeration process which undergoes changes in temperature, pressure and possibly phase to absorb heat at a lower temperature and reject it at a higher temperature.

As used herein the term "subcooling" means cooling a liquid to be at a temperature lower than the saturation temperature of that liquid for the existing pressure.

As used herein the term "indirect heat exchange" means the bringing of fluids into heat exchange relation without any physical contact or intermixing of the fluids with each other.

As used herein the term "phase separator" means a vessel wherein incoming fluid is separated into individual vapor and liquid fractions. Typically the vessel has sufficient cross sectional area so that the vapor and liquid are separated by gravity.

As used herein the terms "upward flow" and "downward flow" encompass substantially upward flow and downward flow as would occur in a crossflow arrangement.

DETAILED DESCRIPTION

Figure 1:
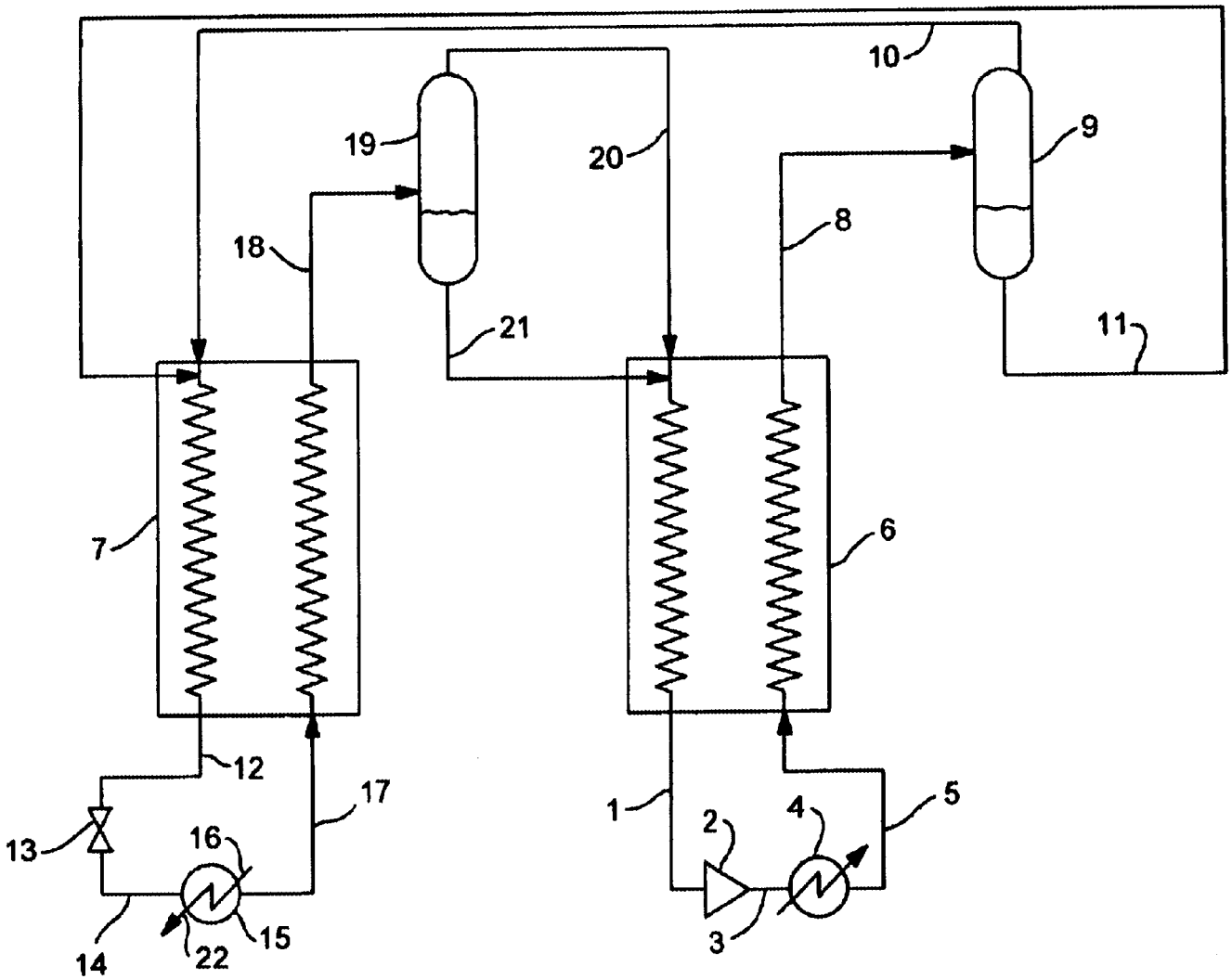
FIG. 1 is a schematic representation of one preferred embodiment of the invention.

The invention will be described in detail with reference to the Drawings. Referring now to FIG. 1, warm refrigerant fluid 1 is compressed by passage through compressor 2 to a pressure generally within the range of from 100 to 800 pounds per square inch absolute (psia). While the refrigerant fluid may be a single component refrigerant fluid, the invention is most advantageous when the refrigerant fluid employed in the invention is a multicomponent refrigerant fluid. The multicomponent refrigerant fluid which may be used in the practice of this invention preferably comprises at least two species from the group consisting of fluorocarbons, hydrofluorocarbons, hydrochlorofluorocarbons, fluoroethers, atmospheric gases and hydrocarbons, e.g. the multicomponent refrigerant fluid could be comprised only of two fluorocarbons.

One preferred multicomponent refrigerant useful with this invention preferably comprises at least one component from the group consisting of fluorocarbons, hydrofluorocarbons, and fluoroethers, and at least one component from the group consisting of fluorocarbons, hydrofluorocarbons, hydrochlorofluorocarbons, fluoroethers, atmospheric gases and hydrocarbons.

In one preferred embodiment of the invention the multicomponent refrigerant consists solely of fluorocarbons. In another preferred embodiment of the invention the multicomponent refrigerant consists solely of fluorocarbons and hydrofluorocarbons. In another preferred embodiment of the invention the multicomponent refrigerant consists solely of fluorocarbons, fluoroethers and atmospheric gases. In another preferred embodiment of the invention the multicomponent refrigerant comprises one or more hydrocarbons and atmospheric gases. Most preferably every component of the multicomponent refrigerant is either a fluorocarbon, hydrofluorocarbon, fluoroether or atmospheric gas.

Compressed refrigerant fluid 3 is cooled of the heat of compression by passage through aftercooler 4 and then is passed in stream 5 to the bottom of first vertically oriented heat exchanger section 6. Stream 5 may contain a liquid portion and, if so, stream 5 may be phase separated and provided to heat exchanger section 6 in separate phases. As used herein the term "bottom" when referring to a heat exchanger section encompasses substantially the bottom as well as the absolute bottom of the heat exchanger section. Similarly, as used herein the term "top" when referring to a heat exchanger section encompasses substantially the top as well as the absolute top of the heat exchanger section.

As the refrigerant fluid flows upwardly through first heat exchanger section 6 it is cooled and preferably partially condensed by indirect heat exchange with warming refrigerant fluid as will be more fully described below. In the case where the refrigerant fluid is a multicomponent refrigerant fluid, one or more of the heavier, i.e. less volatile, components of the multicomponent refrigerant fluid will condense as the multicomponent refrigerant fluid flows upwardly through first heat exchanger section 6.

First vertically oriented heat exchanger section 6 and second vertically oriented heat exchanger section 7 could be separately standing sections, as illustrated in FIG. 1, or could be incorporated into a single structure. Heat exchanger sections 6 and 7 could be of the plate-fin type, wound coil type, brazed plate type, tube in tube type, or shell and tube type. When the heat exchanger sections are of the plate-fin type, as is the case with the embodiment illustrated in FIG. 1, it is preferred that phase separators be used to ensure even distribution of the phases between layers. However, if the two sections are incorporated into one brazed section, then a phase separator will not be required.

Referring back now to FIG. 1, the cooled refrigerant fluid is passed from the top of first vertically oriented heat exchanger section 6 to the top of second vertically oriented heat exchanger section 7. In the embodiment illustrated in FIG. 1 the refrigerant fluid is partially condensed as it is cooled by upward passage through first heat exchanger section 6 and is passed first in line 8 to phase separator 9 wherein it is separated into vapor and liquid phases. The vapor is passed in line 10 and the liquid is passed in line 11 from phase separator 9 to the top of second heat exchanger section 7 wherein they are mixed using a conventional mixing device (not shown) thereby ensuring even distribution of the phases of the refrigerant fluid between the layers of the plate-fin heat exchanger section.

The cooled refrigerant fluid is further cooled by downward flow through second heat exchanger section 7 by indirect heat exchange with warming refrigerant fluid as will be more fully described below. When the refrigerant fluid is a multicomponent refrigerant fluid which has been partially condensed by the upward flow through first heat exchanger section 6, it is further condensed, preferably completely condensed, by the downward flow through second heat exchanger section 7, i.e. this downward flow serves to condense the light or more volatile component or components in the multicomponent refrigerant fluid mixture.

The further cooled refrigerant fluid is passed in stream 12 from the bottom of second heat exchanger section 7 to expansion device 13 wherein it is expanded to generate refrigeration. Typically expansion device 13 is a Joule- Thomson valve wherein the expansion is isenthalpic or is a turboexpander. The refrigeration bearing refrigerant fluid 14 is then employed to provide refrigeration by indirect heat exchange to a refrigeration load. In the embodiment of the invention illustrated in FIG. 1, this indirect heat exchange occurs in heat exchanger 15 with refrigerant load fluid 16 which results in the production of refrigerated fluid 22. The refrigerant load could be any load, examples of which include atmosphere or heat exchange fluid used in food freezing, a process or heat exchange stream used in a cryogenic rectification plant, and a natural gas stream to be liquefied for the production of liquefied natural gas.

The refrigerant fluid is passed from expansion device 13 to the bottom of second vertically oriented heat exchanger section 7. In the embodiment of the invention illustrated in FIG. 1 the refrigerant fluid first provides refrigeration to the refrigeration load before entering the bottom of second heat exchanger section 7 as stream 17. Phase separators are not shown at the inlet to either heat exchanger section, but such phase separators could be, and generally are, employed to improve distribution. As the refrigerant fluid flows upwardly in second heat exchanger 7 it is warmed and preferably partly vaporized by indirect heat exchange with the downwardly flowing further cooling refrigerant fluid in second heat exchanger section 7 as was previously described. The warmed, preferably two phase, refrigerant fluid 18 is passed from the top of second heat exchanger section 7 to the top of first heat exchanger section 6. In the embodiment of the invention illustrated in FIG. 1, the warmed refrigerant fluid 18 is passed from the top of second heat exchanger section 7 to phase separator 19 wherein it is separated into vapor and liquid phases. The vapor is passed in stream 20 and the liquid is passed in stream 21 from phase separator 19 to the top of first heat exchange section 6 wherein they are mixed using a conventional mixing device (not shown) thereby ensuring even distribution of the phases of the refrigerant fluid between the layers of the plate-fin heat exchanger section.

The warmed refrigerant fluid introduced into the top of first heat exchanger section 6 is further warmed, and preferably completely vaporized, by downward flow within first heat exchanger section 6 by indirect heat exchange with the cooling compressed refrigerant fluid as was previously discussed. The resulting refrigerant fluid is withdrawn from the bottom of first heat exchanger section 6 as warm refrigerant fluid 1 for passage to compressor 2 and the circuit is completed.

Figure 2:
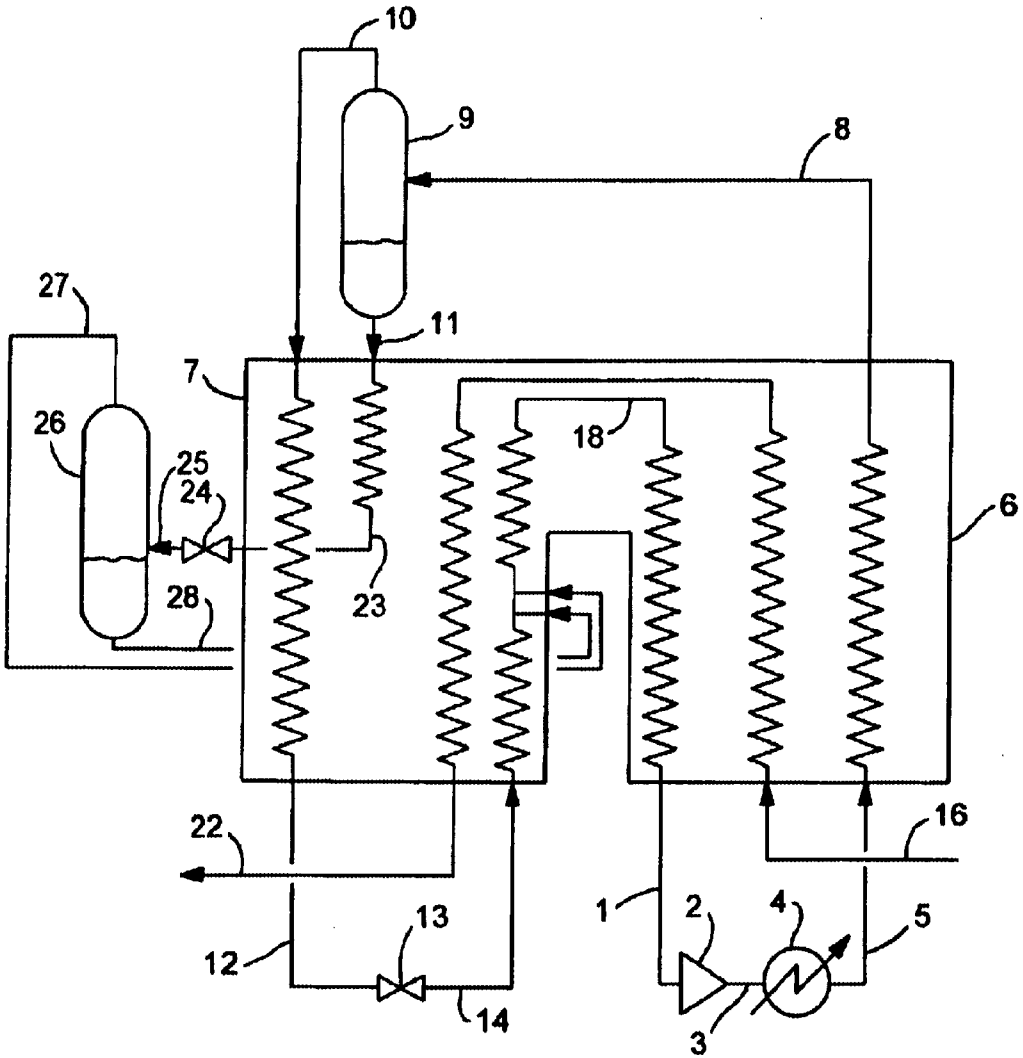
FIG. 2 is a schematic representation of another preferred embodiment of the invention which employs internal recycle of the refrigerant fluid.

FIG. 2 illustrates another preferred embodiment of the invention which employs internal recycle and wherein the heat exchanger sections are incorporated into a single structure. For a mixture of, for example, fluorocarbons used as the refrigerant fluid, the minimum temperature is limited by the freezing point of the liquid phase. The internal recycle is used to prevent heavy components from reaching the cold end where they would freeze and block the passages. The numerals of FIG. 2 are the same as those of FIG. 1 for the common elements and these common elements will not be described again in detail.

Referring now to FIG. 2, the vapor and liquid from phase separator 9 are passed separately down second vertically oriented heat exchanger section 7. The liquid is subcooled and after partial traverse of second heat exchanger section 7 the subcooled liquid 23 is flashed across valve 24 and passed as two phase stream 25 into phase separator 26 wherein it is separated into vapor and liquid phases. The vapor is passed out from phase separator 26 in stream 27 and the liquid is passed out from phase separator 26 in stream 28. Both of these streams are recycled by mixing with the warming, preferably partially vaporizing, refrigeration bearing refrigerant fluid which is passing upwardly through second heat exchanger section 7 and which is providing refrigeration to the refrigeration load 16 to produce refrigerated fluid 22. As can be seen, in the embodiment of the invention illustrated in FIG. 2, the heat exchange between the refrigeration bearing refrigerant fluid and the refrigeration load occurs within second heat exchanger section 7 rather than in a separate heat exchanger as in the embodiment of the invention illustrated in FIG. 1.

The invention improves upon conventional methods of preventing pool boiling since the boiling passages can be configured to have a smaller cross section in the second section than in the first section. This will increase the velocity of the boiling stream at the cold end. By placing the two heat exchanger sections next to one another, an increase in cold box height is avoided (in fact cold box height is reduced). Unlike the use of crossflow to reduce heat exchanger height and therefore to lower cold box height, an optimum countercurrent flow can still be maintained. Unlike use of the hardway fins to increase vapor velocity, an excessive pressure drop is not generated. The conventional measures to increase velocity (hardway fins, crossflow sections) may still be applied, but can be used in a less severe form. On the basis of a given heat duty (thermal load) and available pumping power the invention reduces the height of the cold box. For a given heat duty, a heat exchanger of either the conventional ("cold end down"), or even of the "cold end up" configuration, will be taller compared to the height of the cold box with the use of the invention.

The conventional arrangement requires the condensing and boiling fluids to enter at different elevations. In contrast the invention locates hot and cold inlets at approximately the same elevation. If the invention is applied to a mixed refrigerant cycle using a multicomponent refrigerant fluid, the aftercooler can be located on the ground. There is no requirement to transport a two-phase mixture to the top of the cold box. This avoids an increase in compressor power required to transport fluid to the top of the heat exchanger, the added capital cost of locating the aftercooler on top of the cold box, or the addition of extra equipment in the form of a liquid pump. For MGR cycles which use an internal recycle, the liquid present in the first heat exchanger section (which will be richer in heavy components) will naturally drain to the warm end, where it will not freeze upon shutdown of the compressor. Moreover, with the invention the upward condensation heat exchanger section or first section does not require complete condensation of the fluid, so the vapor velocity alone is sufficient to prevent backmixing.

It is believed that the best mode of application for this invention is in a process where a multicomponent boiling stream is present, and highly effective heat transfer (that is small temperature difference) is desired. Preferably the heat exchanger sections are plate-fin type heat exchangers because this type of device provides a large surface area which aids effective heat transfer. The two heat exchanger sections will be insulated. To maintain highly effective heat transfer, an insulated gap must be present between the two heat exchanger sections to prevent heat transmission from the warm end to the cold end. The size of gap is determined according to the thickness of insulation required to prevent significant heat transfer between the sections. The heat exchanger sections may be enclosed in a cold box. In this case the cold box is filled with insulation (perlite or similar) which also fills the gap between the sections.

The boiling fluid travels upwards in the second section at a velocity sufficient to avoid pool boiling. The condensing vapor phase in the upflow leg must have sufficient velocity to be above the flow reversal point. The gas velocity at which flow reversal begins (i.e. a switch from upward flow of vapor and liquid to upward flow of vapor and some downward flow of liquid) can be determined from the criteria which states that $$j_g^* = \frac{Gx}{\rho_g^{1/2}[gD_h(\rho_L - \rho_g)]^{1/2}} > 0.9$$

where

| Symbol | Description | SI UNIT |
|---|---|---|
| G | = Mass flow per unit area | $kg/m^2s$ |
| x | = Mass fraction vapor | — |
| $\rho_g$ | = Vapor phase density | $kg/m^3$ |
| $\rho_L$ | = Liquid phase density | $kg/m^3$ |
| $D_h$ | = Hydraulic diameter | m |
| g | = Gravitational acceleration | $m/s^2$ |

Although the invention has been described in detail with reference to certain preferred embodiments, those skilled in the art will recognize that there are other embodiments of the invention within the spirit and the scope of the claims.

What is claimed is:

1. A method for providing refrigeration to a refrigeration load comprising:

(A) compressing a warm refrigerant fluid, and cooling the compressed refrigerant fluid by upward flow through a first heat exchanger section;

(B) further cooling the cooled refrigerant fluid by downward flow through a second heat exchanger section, expanding the further cooled refrigerant fluid to generate refrigeration, and providing refrigeration from the refrigeration bearing refrigerant fluid to a refrigeration load;

(C) warming the resulting refrigerant fluid by indirect heat exchange with the further cooling refrigerant fluid; and (D) further warming the resulting refrigerant fluid by indirect heat exchange with the cooling compressed refrigerant fluid to produce said warm refrigerant fluid.

2. The method of claim 1 wherein the refrigerant fluid is a multicomponent refrigerant fluid.

3. The method of claim 1 wherein the cooling compressed refrigerant fluid is partially condensed by the upward flow through the first heat exchanger section.

4. The method of claim 1 wherein a portion of further cooling refrigerant fluid is condensed by the downward flow through the second heat exchanger section.

5. The method of claim 1 wherein the cooled refrigerant fluid is partially condensed after the upward flow through the first heat exchanger section and is passed as separate vapor and liquid streams downwardly through the second heat exchanger section, and further comprising subcooling the liquid stream by downward flow through the second heat exchanger.

6. The method of claim 1 wherein the provision of refrigeration from the refrigeration bearing refrigerant fluid to the refrigeration load takes place outside the first and second heat exchanger sections.

7. The method of claim 1 wherein the provision of refrigeration from the refrigeration bearing refrigerant fluid to the refrigeration load takes place at least in part within the second heat exchanger section.

8. A dual section refrigeration system comprising:

(A) a first vertically oriented heat exchanger section, a compressor, and means for passing refrigerant fluid from the compressor to the bottom of the first vertically oriented heat exchanger section;

(B) a second vertically oriented heat exchanger section, and means for passing refrigerant fluid from the top of the first vertically oriented heat exchanger section to the top of the second vertically oriented heat exchanger section;

(C) an expansion device, means for passing refrigerant fluid from the bottom of the second vertically oriented heat exchanger section to the expansion device, and means for passing refrigerant fluid from the expansion device to the bottom of the second vertically oriented heat exchanger section; and (D) means for passing refrigerant fluid from the top of the second vertically oriented heat exchanger section to the top of the first vertically oriented heat exchanger section, and means for passing refrigerant fluid from the bottom of the first vertically oriented heat exchanger section to the compressor.

9. The dual section refrigeration system of claim 8 wherein the means for passing refrigerant fluid from the top of the first heat exchanger section to the top of the second heat exchanger section includes a phase separator.

10. The dual section refrigeration system of claim 8 wherein the means for passing refrigerant fluid from the top of the second heat exchanger section to the top of the first heat exchanger section includes a phase separator.

11. The dual section refrigeration system of claim 8 wherein the first vertically oriented heat exchanger section and the second vertically oriented heat exchanger section are separately standing sections.

12. The dual section refrigeration system of claim 8 wherein the first vertically oriented heat exchanger section and the second vertically oriented heat exchanger section are incorporated into a single structure.

* * * * *